US006796514B1

(12) United States Patent
Schwartz

(10) Patent No.: US 6,796,514 B1
(45) Date of Patent: Sep. 28, 2004

(54) PRE-PACKAGED MATERIAL SUPPLY ASSEMBLY

(75) Inventor: Thomas W. Schwartz, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/428,740

(22) Filed: May 2, 2003

(51) Int. Cl.[7] ..... B05B 7/30

(52) U.S. Cl. ..... 239/345; 239/318; 239/340; 239/74

(58) Field of Search ..... 239/302, 320, 239/323, 318, 328, 345, 340, 74; 285/360, 376, 401; 222/189.06, 481, 158; 141/383, 346, 385, 384

(56) References Cited

U.S. PATENT DOCUMENTS

| | | | | | |
|---|---|---|---|---|---|
| 5,143,294 | A | * | 9/1992 | Lintvedt | 239/328 |
| 5,816,501 | A | * | 10/1998 | LoPresti et al. | 239/302 |
| 6,588,681 | B2 | * | 7/2003 | Rothrum et al. | 239/328 |
| 6,698,670 | B1 | * | 3/2004 | Gosis et al. | 239/376 |
| 2003/0006310 | A1 | | 1/2003 | Rothrum et al. | |

FOREIGN PATENT DOCUMENTS

| | | |
|---|---|---|
| WO | WO 98/32539 | 7/1998 |

OTHER PUBLICATIONS

U.S. patent application Ser. No. 10/112,182, filed Mar. 28, 2003, Small Liquid Supply Assembly.

* cited by examiner

*Primary Examiner*—Gene Mancene
*Assistant Examiner*—Thach H. Bui
(74) *Attorney, Agent, or Firm*—William L. Huebsch

(57) ABSTRACT

A material supply assembly for use with a spraying device, which material supply assembly includes a housing of stiff material comprising a side wall having a top end defining an opening into a recess defined by the housing; and a pre-filled container comprising a stiff annular lip adapted to be positioned along the top end of the side wall, and a flexible portion fixed to the annular lip and adapted to extend into the cavity in the housing when the annular lip is positioned along the top end of the side wall. The flexible portion has an inner surface defining a cavity, and a quantity of material is within the cavity in the flexible portion. A polymeric membrane extends across and is sealed to the annular lip to retain the material in the cavity. The material supply assembly also includes an adapter assembly having a through opening, at one end of which is a transverse portion including a peripheral part adapted for engagement with the annular lip positioned on the top end of the container, and at the other end of which is a portion adapted to engage the inlet port of a liquid spraying device. Means are provided for securing the peripheral part to the housing with the annular lip therebetween. A piercing structure projects from the central portion and has a distal end portion adapted to pierce the membrane as the peripheral part is engaged with the annular lip positioned on the top end of the housing.

15 Claims, 5 Drawing Sheets

PRE-PACKAGED MATERIAL SUPPLY ASSEMBLY

FIELD OF THE INVENTION

The present invention relates to the supply assemblies that supply materials to be sprayed (e.g., paint, undercoating material, abrasive granules, or liquid adhesive) to spraying devices such as liquid spray guns or sand blasting guns, and in one aspect, to such material supply assemblies in which the materials are supplied to the spraying devices from within collapsible containers.

BACKGROUND OF THE INVENTION

Various liquid supply assemblies have been described for supplying mixtures of component liquids to be sprayed to gravity feed liquid (e.g., paint) spraying devices such as spray guns, including the supply assembly having a collapsible liner that is described in International Publication Number WO 98/32539 of Jul. 30, 1998, the content whereof is incorporated herein by reference, and the improvement in that supply assembly described in U.S. patent application Ser. No. 09/901,410 filed Jul. 9, 2001, the content whereof is also incorporated herein by reference.

The liquid supply assembly described in WO 98/32539 includes a container of stiff polymeric material comprising a side wall with a top end of the side wall defining an opening into a cavity in the container, and a flexible liner within that cavity, which liner corresponds in shape to an inner surface of the container, and has an annular lip along the top end of the side wall that defines an opening into a cavity in the liner. That liquid supply assembly further includes an adapter assembly comprising a central portion having a through opening that is adapted to engage the inlet port of the gravity feed liquid spraying device, a transverse portion including a peripheral part adapted for engagement within the flexible liner adjacent the top end of the container, and means for securing the flexible liner around that peripheral part of the adapter assembly. The flexible liner within the cavity in the container can be used as a receptacle for measuring and mixing two or more component liquids for the mixture to be sprayed. After the liquids are mixed the adapter assembly is secured to the flexible liner, the adapter assembly is engaged with the inlet port of the spraying device, the liquid supply assembly is positioned above the spraying device with the bottom wall of the container uppermost, and the spraying device is operated to dispense the liquid mixture from within the flexible liner. The flexible liner collapses as the liquid mixture is dispensed to restrict the formation of a vacuum in the liner.

U.S. patent application Ser. No. 09/901,410 describes a liquid supply assembly for use with gravity feed liquid spraying devices that, like the liquid supply assemblies described in WO 98/32539, provides indicia by which component liquids for mixtures of liquids to be sprayed by such devices are measured to provide predetermined ratios. The liquid supply assembly described in U.S. patent application Ser. No. 09/901,410 affords conveniently providing indicia that facilitates measuring many more of the different ratios of different component liquids that might be desired by operators of such liquid spraying devices than when such indicia are provided on the containers or mixing cups as described in WO 98/32539. This is done by providing different indicia on a plurality of different indicating sheets of resiliently flexible polymeric material, any one of which sheets can be positioned between the side wall of the container and the flexible liner.

A liquid supply assembly for use with gravity feed liquid spraying devices incorporating features described in WO 98/32539 and in U.S. patent application Ser. No. 09/901,410 is currently being sold by Minnesota Mining and Manufacturing Company under the trade designation "3M (T.M.) Paint Preparation System". That liquid supply assembly is sold in two different fairly large sizes (i.e., about 20 fluid ounces or 600 ml and about 32.1 fluid ounces or 950 ml) and incorporates several disposable parts that are typically discarded rather than being cleaned after liquid is sprayed from them.

U.S. patent application Ser. No. 10/112,182 filed Mar. 28, 2002, describes economical and easily usable liquid supply containers for a small amounts of liquid to be sprayed by a gravity feed spraying device such as a spray gun, such as, for example, when a painter is testing a paint mixture for a color match, or is painting a small surface area, or is spraying a thinned clear coat or blending clear to blend new and old layers of clear coat.

The containers described above arc effective for use with materials mixed near the site of application of the materials.

DISCLOSURE OF THE INVENTION

The present invention provides a material supply assembly for use with a spraying device such as a spray gun, which material supply assembly is useful for supplying material to be sprayed that has been prepared and packaged at a location different than that at which the material is to be sprayed.

The material supply assembly according to the present invention includes a housing of stiff material comprising a side wall having a top end defining an opening into a recess defined by the housing; and a pre-filled container comprising a stiff annular lip adapted to be positioned along the top end of the side wall, and a flexible portion fixed to the annular lip and a dapted to extend into the cavity in the housing when the annular lip is positioned along the top end of the side wall. The flexible portion has an inner surface defining a cavity opening through the annular lip, a quantity of material to be sprayed is within the cavity, and a polymeric membrane extends across and is sealed to the annular lip to retain the material in the cavity. Also included in the supply assembly is an adapter assembly having a through opening, having at one end a transverse portion including a peripheral part adapted for engagement with the annular lip positioned on the top end of the housing, and having at its opposite end a portion adapted to engage the inlet port of a material spraying device. Means are provided for sealing the peripheral part to the housing with the annular lip between them. A piercing structure projects from the central portion and has a distal end portion adapted to pierce the membrane as the peripheral part is engaged with the annular lip positioned on the top end of the housing so that the material can then flow from the cavity in the flexible portion through the adapter assembly into the spraying device.

The material sup ply assembly can conveniently be used for a variety of pre-packaged materials to be sprayed from a spraying device, such as paints, coating or sealing materials, liquid adhesives, abrasive granules, or the like.

The piercing structure can include an outlet portion having a through central opening and having a periphery firmly engaged with a surface defining the through opening in the adapter assembly; a second opposite end comprising a piercing point adapted to pierce through the membrane sealed across the annular lip; and an inlet portion between its outlet portion and piercing point that projects past the peripheral part of the transverse portion. That inlet portion has inlet passageways spaced around its periphery that communicate with the through opening in the outlet portion.

BRIEF DESCRIPTION OF THE DRAWINGS

The present invention will be further described with reference to the accompanying drawing wherein like reference numeral s refer to like parts in the several views, and wherein.

DETAILED DESCRIPTION OF THE INVENTION

Figure 1:
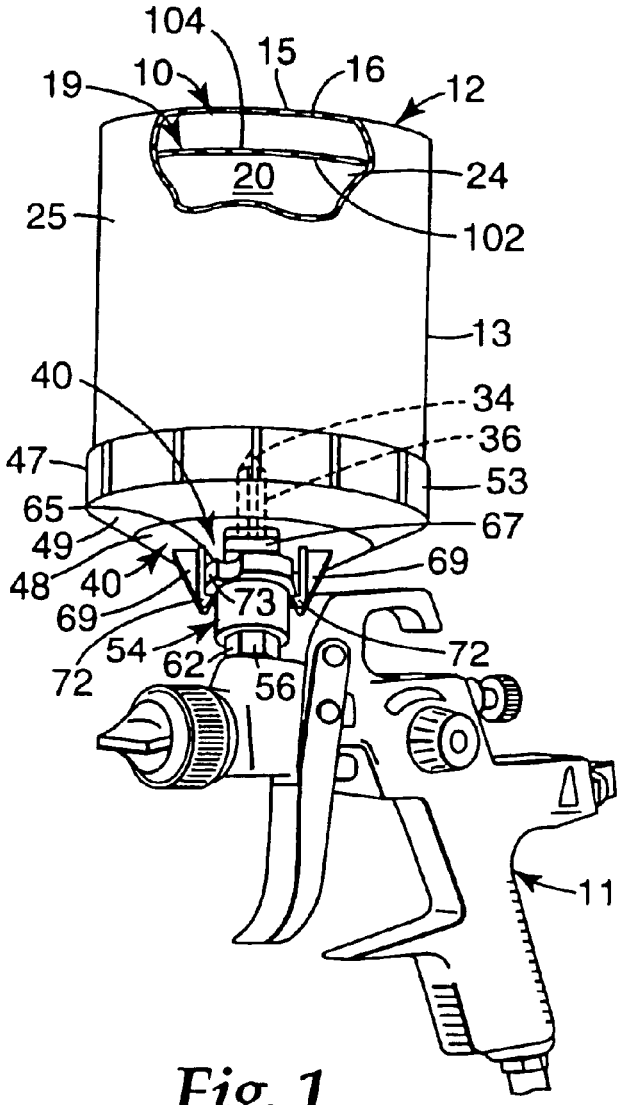
FIG. 1 is a perspective view of a material supply assembly according to the present invention shown attached to a spraying device for low viscosity liquids, which assembly has parts broken away to show details.
Figure 2:
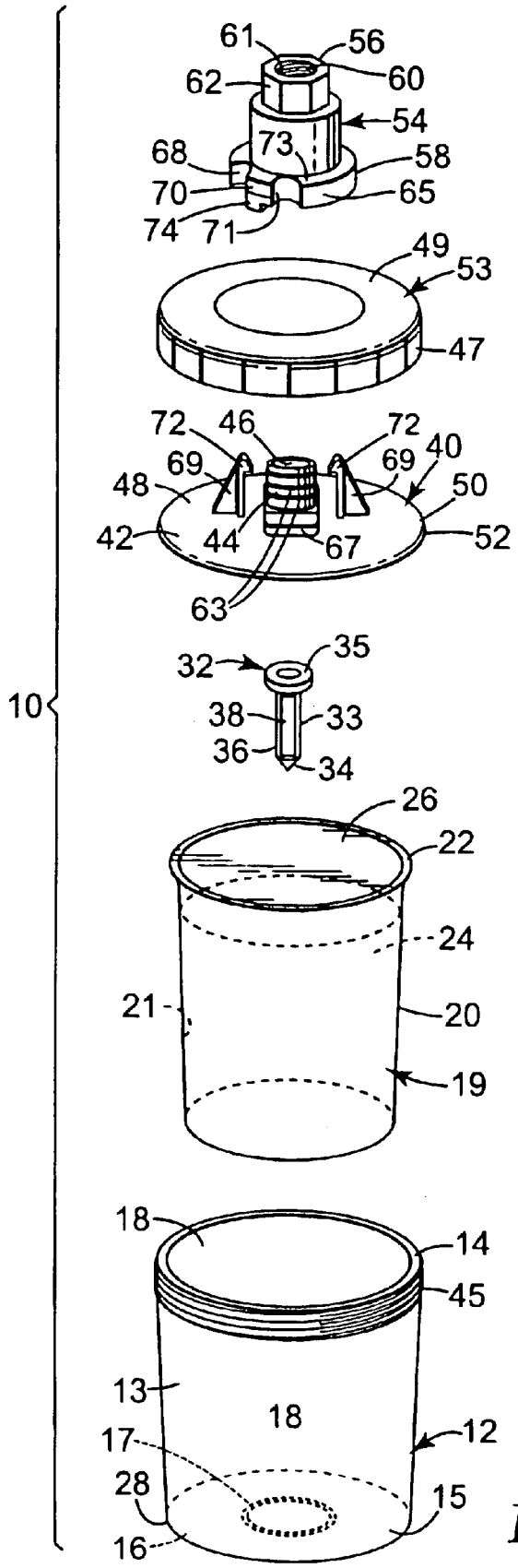
FIG. 2 is an exploded perspective view of the material supply assembly of FIG. 1.

Referring now to the drawing there is illustrated a material supply assembly according to the present invention generally designated by the reference numeral 10. As is illustrated in FIG. 1, that material supply assembly 10 can be used to supply material or liquid to be sprayed to a conventional gravity fed spraying device for low viscosity liquids (e.g., paint) such as the spraying device or spray gun 11 illustrated that is commercially designated a "SATA" (t.m.) NR-95" spray gun and is commercially available from Sata, Farbspritzechnik GmbH & Co., Kornwestheim, Germany. Alternatively, as will be further described below, the material supply assembly 10 could be used to supply different materials to be sprayed to other types of spraying devices, such as a spraying device or spray gun 80 illustrated in FIG. 5 that is adapted to spray high viscosity liquid materials such as automotive under-coatings, spraying devices or spray guns such as those described below that can spray liquid adhesives, or a spraying device such as the sand blasting gun 90 illustrated in FIG. 6 that is adapted for spraying out abrasive granules.

The material supply assembly 10 includes a housing 12 of stiff polymeric material which preferably may or alternatively may not be visually transparent. The housing 12 comprises a generally cylindrical side wall 13 having top and bottom ends 14 and 15, and optionally includes a bottom wall 16 extending across the bottom end 15 of the side wall 13 that has a central circular through opening 17. The top end 14 of the side wall 13 defines an opening into a cavity in the housing 12 defined by its inner surface 18.

The material supply assembly 10 further includes a pre-filled container 19 including a stiff but thin and flexible visually transparent liquid impervious collapsible cup-like flexible portion 20 adapted to be positioned within the cavity in the housing 12 (e.g., the flexible portion 20 can be vacuum formed from a sheet of low density polyethylene to have a side wall about 0.004 to 0.01 inch or 0.1 to 0.25 mm thick and a bottom wall about 0.001 inch or 0.25 mm thick or thicker so that the bottom wall tends to stay generally planer as the side wall collapses). The flexible portion 20 has side and bottom walls adapted to be received in the cavity in the housing 12, and an inner surface 21 defining a cavity in the flexible portion 20. An annular radially outwardly projecting flange or lip 22 is fixed to and extends around the top end 14 of the side wall 13 that defines an opening into the cavity in the flexible portion 20. The flexible portion 20 and the housing 12 can be made in a wide range of sizes such as about 950 milliliters (32 ounces), or about 650 milliliters (22 ounces), about 250 milliliters (8 ounces), or about 125 milliliters (4 ounces). A quantity of material 24 to be sprayed (e.g., paint, liquid adhesive, liquid sealing or undercoating material, abrasive granules or powder, etc.) is contained within the cavity in the flexible portion 20, and the pre-filled container 19 includes a polymeric membrane 26 (e.g., the polyethylene coated polyester membrane commercially available under the trade designation "Scotch Pac" from 3M Company, St. Paul, Minn.) extending across and scaled to the annular lip 22 to retain the material 24 in that cavity.

The material supply assembly 10 includes an adapter assembly including a first adapter 40, preferably molded of polymeric material (e.g., polyethylene). The first adapter 40 comprises a central generally cylindrical portion 44 having an inner surface 46 defining a through opening and a frusto-conical transverse portion 48. The transverse portion 48 includes a radially projecting flange 52 adapted to be positioned along the side of the membrane 26 sealed to the lip 22 opposite the lip 22 and the top end 14 of the housing 12.

The material supply assembly 10 also includes a piercing structure 32 adapted to have a first end 35 firmly but removably engaged with the surface 46 defining the through opening in the cylindrical portion 44 and to project past the flange 52 from the side of the first adapter 40 opposite the cylindrical portion 44. The piercing structure 32 can include the stiff polymeric frame 33 of a known commercially available type of filter assembly (e.g., the filter assembly commercially available from Filtertek, Hebron, Illinois) to an end of which frame 33 has been added a conical piercing point 34 adapted to pierce through and rupture the membrane 26 sealed across the annular lip 22 when the piercing structure 32 is mounted on the first adapter 40, the pre-filled container 19 is in the housing 12 with its lip 22 around the top end 14 of the side wall 13, and the flange 52 of the first adapter 40 is moved into engagement with the membrane 26 sealed to the side of the lip 22 opposite the housing 12. The frame 33 comprises an outlet portion at the first end 35 of the piercing structure 32 that has a through central opening and a cylindrical outer surface frictionally engaged within the inner surface 46 defining the through opening in the central portion 44. The frame 33 further includes an inlet portion projecting from its outlet portion and the inner surface of the transverse portion 48 of the first adapter 40. The inlet portion has four axially extending rectangular inlet passageways 38 spaced around its periphery that communicate with the through opening in its outlet portion. A filter screen of a mesh size appropriate to filter the material 24 (e.g., paint) being sprayed can extend across the inlet passageways 38, or no filter need be used across the inlet passageways when other materials 24 (e.g., abrasive granules or high viscosity undercoating materials or liquid adhesive) are to be sprayed.

The material supply assembly 10 also includes a securing ring 53 having a central opening through which the central part of first adapter 40 can project, a generally radially inwardly projecting portion 49 shaped to overlay and contact the radially projecting flange 52 along the outer surface of the first adapter 40, and an axially projecting portion 47 having threads along its inner surface. Those threads on the securing ring 53 can be engaged with mating threads 45 around the outer surface of the housing 12 adjacent its top end 14 to clamp the portion 49 of the ring 53 against the outer surface of the transverse portion 48 and thereby releasably secure the lip 22 of the pre-filled container 19 between the housing 12 and the first adapter 40.

The adapter assembly included in the material supply assembly 10 also includes a second adapter 54, preferably of metal (e.g., aluminum or stainless steel), that has first and second spaced end portions 56 and 58, and has a through opening 60 extending through those end portions 56 and 58. The first end portion 56 of the second adapter 54 has internal threads 61 and six flatted wrench engageable surface portions 62 around its periphery, thereby being adapted to be releasably engaged with external threads on the inlet port of the gravity feed spray gun 11. Instead of internal threads 61, the first end portion 56 could alternatively, have any shape needed to properly engage a spray gun, such as external threads (not shown). The first adapter 40 and the second end portion 58 of the second adapter 54 have connector parts that are adapted for releasable liquid tight engagement with their through openings 46 and 60 in communication. Those connector parts include axially spaced radially outwardly projecting sealing rings 63 along the outer surface of the cylindrical portion 44 of the first adapter 40, and a cylindrical inner surface of the second adapter 54 that defines a portion of the through opening 60 in the second end portion of the second adapter 54. That cylindrical portion of the through opening 60 is adapted to receive the cylindrical portion 44 of the of the first adapter 40 in an engaged position with the sealing rings 63 in slightly compressed liquid tight engagement with the cylindrical portion of the through opening 60 and with an end surface on a collar 65 around the second end portion 58 of the second adapter 54 abutting a boss 67 on the first adapter 40 around the cylindrical portion 44. The collar 65 has major cylindrically concave recesses 68 along opposite sides of its periphery adapted to pass the distal ends of hook members 69 projecting from the transverse portion 48 of the first adapter 40 on opposite sides of the cylindrical portion 44 when the cylindrical portion 44 is pressed axially into the cylindrical portion of the through opening 60 with the first and second adapters 40 and 54 in a first relative position at which the hook members 69 are aligned with the major recesses 68 in the collar 65. The first and second adapters 40 and 54 can then be rotated relative to each other to a second relative position to cause the resiliently flexible projecting hook members 69 to be deflected outwardly by, and to move around, cylindrically convex cam lobes 70 projecting radially outwardly on corresponding sides of the major recesses 68 until the projecting hook members 69 are positioned in minor cylindrically concave recesses 71 in the collar 65 at which opposed inwardly projecting lips 72 on the distal ends of the projecting hook members 69 are engaged over a surface 73 of the collar 65 adjacent the first end 56 of the second adapter 54.

Figure 3:
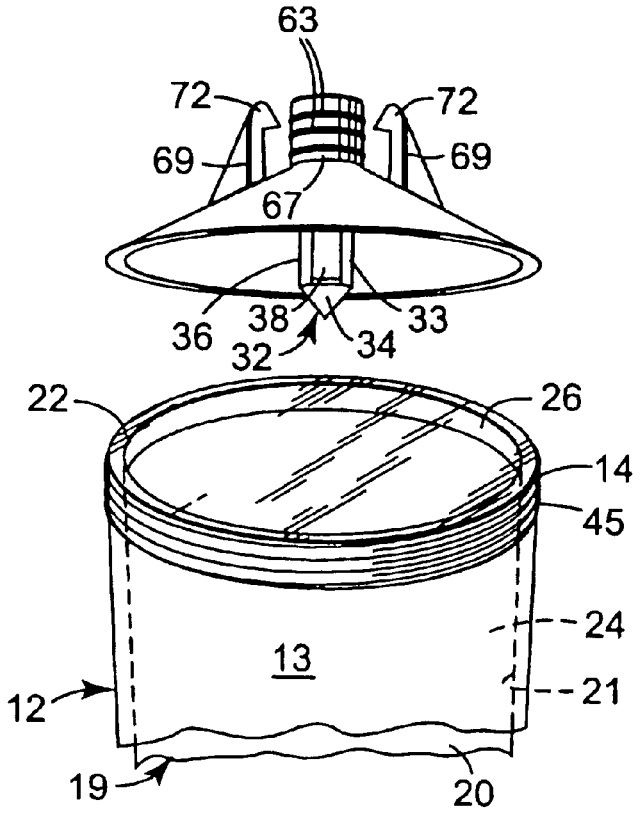
FIG. 3 is an enlarged fragmentary perspective view showing a piercing structure included in the material supply assembly of FIG. 1 about to pierce a membrane on a prefilled container also included in that material supply assembly.
Figure 4:
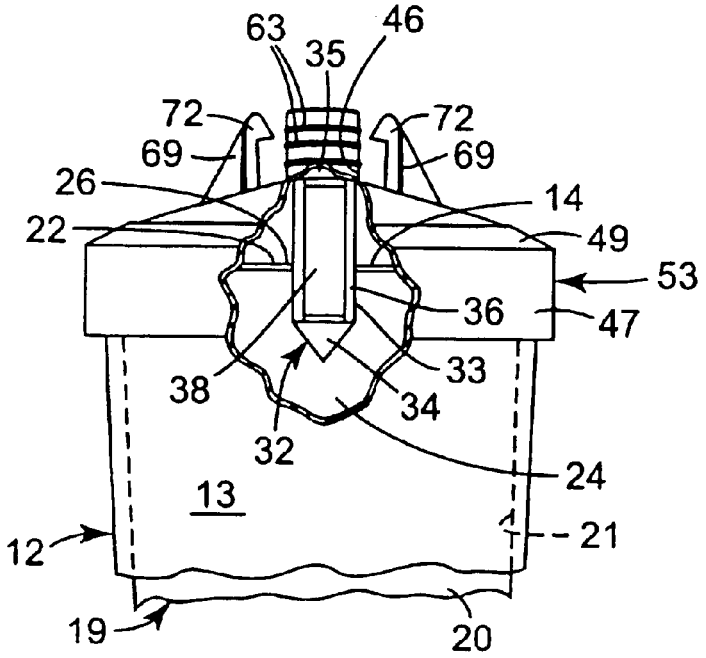
FIG. 4 is an enlarged fragmentary side view similar to FIG. 3 having parts broken away to show the piercing structure after it has pierced the membrane on the pre-filled container.

A method according to the present invention for spraying materials from the gravity fed spraying device 11 includes providing the pre-filled container 19 which can involve forming the flexible portion 20, filling the cavity in the flexible portion 20 with a desired material 24 (e.g., a paint, a coating material, a liquid adhesive, abrasive granules, etc.) and sealing the polymeric membrane 26 across the annular lip 22 which can be done by heat sealing, or possibly sonic sealing, and can be done at a manufacturing facility far from the locations at which the material 24 will be sprayed. A person who wishes to spray the material 24 from the pre-filled container 19 then places the pre-filled container 19 in the housing 12 with its lip 22 along the top end 14 of the housing 12, positions the first end 35 of the piercing structure in engagement with the surface 46 defining the through opening in the cylindrical portion 44 with the piercing structure 32 projecting past the flange 52 on the first adapter 40, and moves the flange 52 on the first adapter 40 into engagement with the membrane 26 sealed to the side of the lip 22 opposite the top end 14 of the housing 12, which causes the piercing structure 32 to puncture the membrane 26 of the pre-filled container 19 (see FIGS. 3 and 4). The inner threads on the axially projecting portion 47 of the ring 53 are then engaged with the threads 45 around the housing 12 until the ring 53 clamps and secures the flange 52 against the membrane 26 sealed to the lip 22 of the pre-filled container 19.

The releasably engageable parts of the first and second adapters 40 and 54 are engaged as described above. The spray gun 11 can then be activated while inverted to cause any air in the pre-filled container 19 to be expelled through the spraying device 11, after which the spray gun is returned to its normal orientation and the material 24 in the pre-filled container 19 will be fed to the spray gun 11 through the piercing structure 32 and the openings 46 and 60 in the adapters 40 and 54, while the flexible portion 20 of the pre-filled container 19 collapses as that material 24 is sprayed out.

After the desired amount of material 24 is sprayed out, the parts of the first and second adapters 40 and 54 are disengaged. The ring 53 can be unscrewed from the housing 12 and the ring 53 and housing 12 can be separated from the first adapter 40 and the container 19 and may be sufficiently clean to be re-used, or else can be discarded. The first adapter 40, the piercing structure 32 and the container 19 with its collapsed flexible portion 20 with any remaining material 24 in the collapsed flexible portion 20 can be discarded, leaving only the second adapter 54 and the spray gun 11 that need to be cleaned.

EXAMPLE 1

A pre-filled container 19 was made in which the cup-like flexible portion 20 was the about 600 milliliter or 20 ounce capacity liner supplied by 3M Company, St. Paul, Minn., for the "3M (t.m.) Paint Preparation System" described above. The cup-like flexible portion 20 was filled with single stage reduced enamel paint (not catalyzed). A piece of "Scotch Pac" film (i.e., polyethylene coated polyester film) from 3M Company was heat sealed across the annular lip 22 around the opening to the flexible portion 20 by using a hot iron to provide the membrane 26 for retaining the paint or material 24 in its cavity. The material supply assembly 10 was formed using, without modification, the housing 12, the securing ring 53, and the second adapter 54 supplied for the "3M (t.m.) Paint Preparation System". The first adapter 40 was modified from the similar structure provided for the "3M (t.m.) Paint Preparation System" by removing the portion of the flange that would, if not removed, project a short distance into the flexible portion 20, so that the flange 22 only contacted the surface of the membrane 26 opposite the annular lip 22. The piercing structure 32 was modified from the filter assembly provided for the "3M (t.m.) Paint Preparation System" by adding the conical piercing point 34. The pre filled container 19 was placed in the housing 12, the first adapter was attached using the securing ring 53 so that the piercing structure 32 penetrated the membrane 26, and the adapter assembly was coupled to a "DeVilbiss" (t.m.) GTI spray gun which is similar to the spray gun 11 noted above. The paint sprayed from that spray gun in the same very acceptable manner that paint sprayed from that spray gun when it was supplied by the unmodified "3M (t.m.) Paint Preparation System".

EXAMPLE 2

A pre-filled container 19 was made in which the cup-like flexible portion 20 was the about 125 milliliter or 4 ounce capacity liner commercially available from Playtex Products, Inc., for use in containing liquid (e.g., milk) in a baby bottle system in which the liner is supported in a housing 12 commercially designated "Drop-Ins" (t.m.). The cup-like flexible portion 20 was filled with single stage reduced enamel paint (not catalyzed). A piece of "Scotch Pac" film from 3M Company was heat sealed across the annular lip 22 around the opening to the flexible portion 20 by using a hot iron to provide the membrane 26 for retaining the paint or material 24 in its cavity. The material supply assembly 10 was formed using, without modification, the housing 12 and the securing ring 53 supplied by Playtex Products, Inc. for use in their baby bottle system; and the second adapter 54 was used, without modification, as supplied for the "3M (t.m.) Paint Preparation System". The first adapter 40 was modified from the similar structure provided for the "3M (t.m.) Paint Preparation System" by reducing the diameter of its flange and shaping it so that the flange 22 only contacts the surface of the membrane opposite the annular lip 22. The piercing structure 32 was modified from the filter assembly provided for the "3M (t.m.) Paint Preparation System" by adding the conical piercing point 34. The pre filled container 19 was placed in the housing 12, the first adapter 40 was attached using the securing ring 53 so that the piercing structure 32 penetrated the membrane 26, and the adapter assembly was coupled to the "DeVilbiss" (t.m.) GTI spray gun used in Example 1. The paint sprayed from that spray gun in the same very acceptable manner that the paint sprayed from that spray gun when it was supplied by the unmodified "3M (t.m.) Paint Preparation System".

EXAMPLE 3

Figure 5:
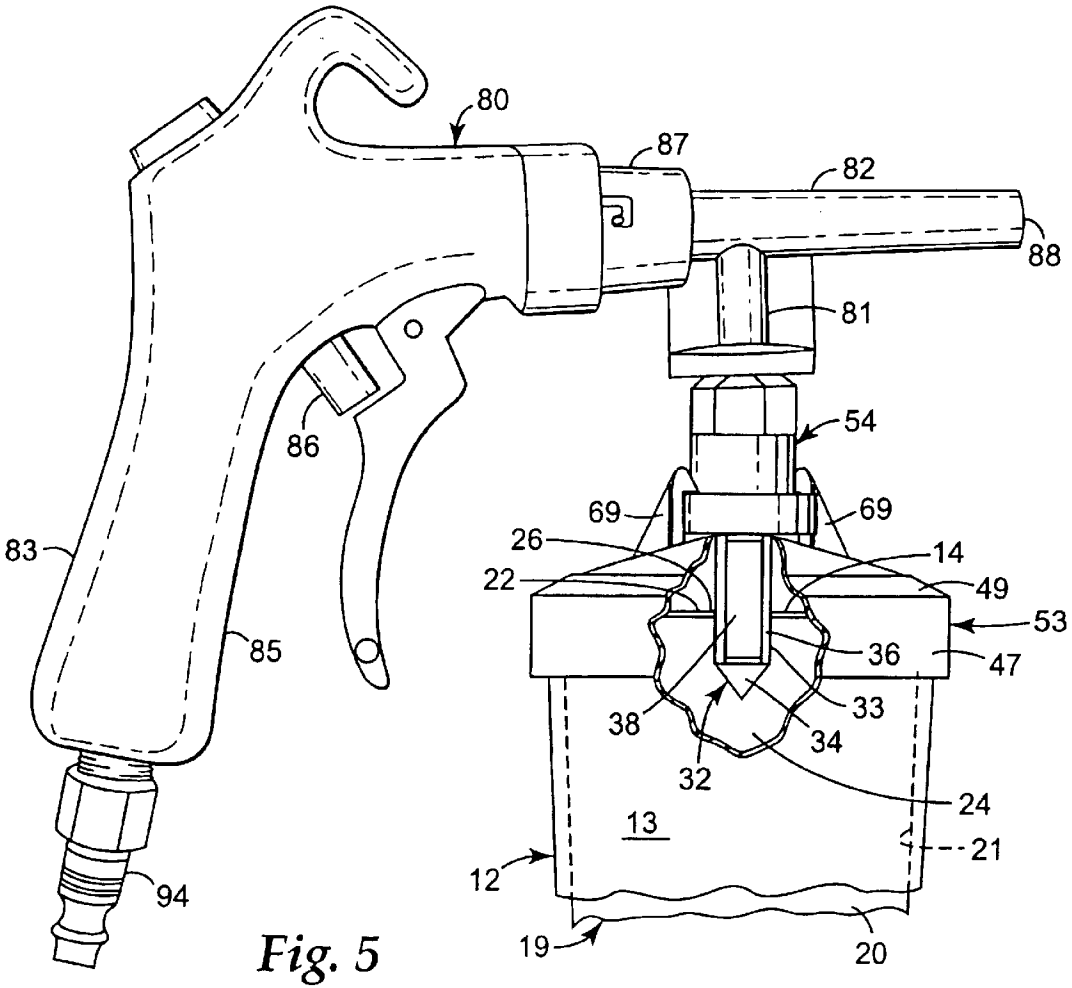
FIG. 5 is a fragmentary side view of the material supply assembly according to the present invention shown attached to a spraying device for high viscosity liquids.

A pre-filled container 19 was made in the same way described in Example 2 using the same about 125 milliliter or 4 ounce capacity liner, except that instead of paint the flexible portion was filled with water base undercoating material commercially available from 3M Company under the trade designation "No. 08804". The material supply assembly 10 was formed using the same housing 12, securing ring 53, second adapter 54, first adapter 40 and piercing structure 32 described in Example 2, except that the filter screen was removed from the piercing structure 32. The pre filled container 19 was placed in the housing 12, and the first adapter 40 was attached using the securing ring 53 so that the piercing structure 32 penetrated the membrane 26. As illustrated in FIG. 5, the second adapter 54 of the adapter assembly was coupled to the material inlet passageway 81 of a disposable nozzle 82 on a spray gun 80 commercially available from 3M Company under the trade designation "No. 08801 No clean-up spray gun". That spray gun 80 is a suction type spray gun and is intended for applying high viscosity coatings such as automobile under coatings. The gun 80 includes a metal handle/activating portion 83 which has a coupler 84 adapted to be coupled to a source of high pressure air on the but of a handle portion 85, and has a trigger operated valve assembly 86 that can be manually manipulated to start and stop the flow of air. The disposable nozzle 82 is of polymeric material (e.g., polyethylene) and has an air inlet end 87 releasably engaged around a cylindrical air outlet end of the handle/activation portion 83, an air outlet end 88, and has the material inlet passageway 81 communicating with a venturi portion of a air passageway between the inlet and outlet ends 87, 88 of the disposable nozzle 82. The disposable nozzle 82 is intended to be used on the handle/activating portion 83 to spray high viscosity coating materials sucked into the air stream through the material inlet passageway 81. Coupling the second adapter 54 to the material inlet passageway 81 positioned the material supply assembly 10 below the nozzle 82 so that suction was required to remove the undercoating material from the container 19, the flexible cuplike portion of which collapsed as the material was sucked out of it. The undercoating material sprayed through the spray gun 80 in the same acceptable manner that the undercoating material would spray through the spray gun 80 if it were supplied by the normally used metal can or polymeric bag.

Since the nozzle 82 and the first adapter 40 are both intended to be disposed of after a single use, the first adapter 40 could be adapted to be attached directly to the material inlet passageway 81 or the nozzle 82 by threads or other wise without the use of the metal second adapter 54.

EXAMPLE 4

A pre-filled container 19 was made, the material supply assembly 10 was formed, and the undercoating material was sprayed through the spray gun 80 in the same way described in Example 3, except that an about 250 milliliter or 8 ounce capacity liner commercially available from Playtex Products, Inc., for use in containing liquid (e.g., milk) in a baby bottle system and the corresponding larger "Drop-Ins" (t.m.) housing 12 were used. As in Example 3, the undercoating material sprayed through the spray gun 80 in the same acceptable manner that the undercoating material would spray through the spray gun 80 if it were supplied by the normally used metal can or polymeric bag.

EXAMPLE 5

Figure 6:
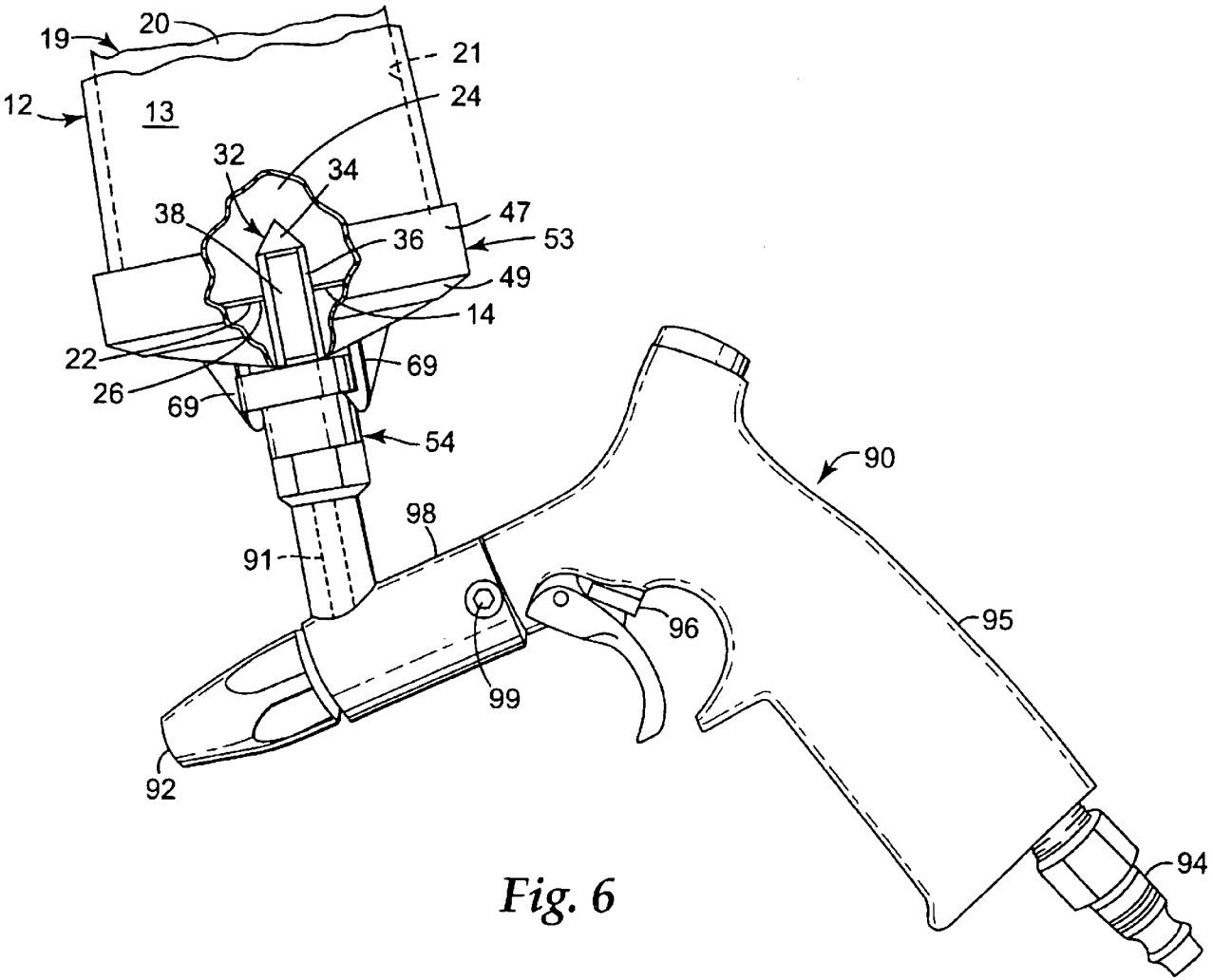
FIG. 6 is a fragmentary side view of the material supply assembly according to the present invention shown attached to a spraying device for abrasive granules.

A pre-filled container 19 was made in the same way described in Example 2 using the same about 125 milliliter or 4 ounce capacity liner, except that instead of paint the flexible portion was filled with grade 80 (i.e., 80 grit) abrasive granules. The material supply assembly 10 was formed using the same housing 12, securing ring 53, second adapter 54, first adapter 40 and piercing structure 32 described in Example 2, except that the filter screen was removed from the piercing structure 32. The pre filled container 19 was placed in the housing 12, and the first adapter 40 was attached using the securing ring 53 so that the piercing structure 32 penetrated the membrane 26. As illustrated in FIG. 6, The second adapter 54 of the adapter assembly was coupled to the material inlet passageway 91 of a sand blasting gun 90 commercially identified as a "MARK 1, AF1018 k AIR SAND BLASTER". That all metal sand blasting gun 90 includes a coupler 94 adapted to be coupled to a source of high pressure air on the but of a handle portion 95, a trigger operated valve assembly 96 that can be manually manipulated to start and stop the flow of air, an outlet nozzle 92, and a generally cylindrical portion 98 between the valve assembly 96 and the nozzle 92 through which the material inlet passageway 91 communicates with a portion of a air passageway between the valve assembly 96 and the nozzle 92. The cylindrical portion 98 was rotated by loosening a set screw 99 to position the inlet passageway 91 normally above the air passageway between the valve assembly 96 and the nozzle 92 so that abrasive granules from the supply assembly were fed by gravity into that air passageway. The gun 90 was used to propel abrasive granules from the material supply assembly 10 against a painted test panel and was found to remove the paint from the test panel in the same acceptable manner as abrasive granules propelled from the sand blasting gun 90 that were supplied to the gun 90 from the normally used metal can.

EXAMPLE 6

A pre-filled container 19 containing abrasive granules was made, a material supply assembly 10 was formed, and the abrasive granules were sprayed through the sand blasting gun 90 in the same way described above in Example 5, the pre-filled container (except for the abrasive granules) and the material supply assembly were the same as those used in Example 1. As in Example 5, the gun 90 was used to propel abrasive granules from the material supply assembly 10 against a painted test panel and was found to remove the paint from the test panel in the same acceptable manner as abrasive granules propelled from the sand blasting gun 90 that were supplied to the gun 90 from the normally used metal can.

EXAMPLE 7

Pre-filled containers 19 were made in the same way described in Example 2 using the same about 125 milliliter or 4 ounce capacity liners, except that instead of paint some of the flexible portions were filled with An experimental adhesive similar to an adhesive commercially designated Pro Spray Water Based Adhesive that is available from 3M Company, St. Paul, Minn., and others were filled with an adhesive commercially designated Fast Bond 49 that is also available from 3M Company. Material supply assemblies 10 were formed using the same housings 12, securing rings 53, second adapters 54, first adapters 40 and piercing structures 32 described in Example 2, except that in some cases the filter screens may have been removed from the piercing structures 32. The pre filled containers 19 were placed in the housing 12, and the first adapters 40 were attached using the securing rings 53 so that the piercing structures 32 penetrated the membranes 26. The second adapters 54 of the adapter assemblies were coupled to the material inlet passageways of a Binks Cub SLG Spray Gun HYLP; an Astro Pneumatic Tool Company HVLP Mini Gravity Feed Spray Gun, model HVLP6GFF; and a Central Pneumatic Professional Mini Air Gravity Paint Spray Gun, Model 43429. The adhesive materials both sprayed through those spray guns in the same acceptable manner that those adhesive materials would spray through those spray guns if it were supplied by the normally used liquid supply systems for those spray guns.

The present invention has now been described with reference to one embodiment and several variations, modifications, and uses thereof. It will be apparent to those skilled in the art that many changes can be made in the embodiment described without departing from the scope of the present invention. Thus, the scope of the present invention should not be limited to the structures, applications and methods described in this application, but only by the structures, applications and methods described by the language of the claims and the equivalents thereof.

What is claimed is:

1. A material supply assembly for use with a spraying device, the material supply assembly comprising:

a housing of stiff material comprising a side wall having a top end, said side wall having an inner surface defining a recess in said housing, and said top end of said side wall defining an opening into said recess;

a pre-filled container comprising a stiff annular lip adapted to be positioned along the top end of said side wall, a flexible portion fixed to the annular lip and adapted to extend into the cavity in the housing when the annular lip is positioned along the top end of the side wall, said flexible portion having an inner surface defining a cavity in said flexible portion opening through the annular lip, a quantity of material within the cavity in the flexible portion, and a polymeric membrane extending across and sealed to said annular lip to retain the material in the cavity;

an adapter assembly having a through opening, having at a first end a transverse portion including a peripheral part adapted for engagement with the annular lip positioned on the top end of said container, and having at a second end a portion adapted to engage the inlet port of the material spraying device;

means adapted for securing the peripheral part to the housing with the annular lip therebetween, and a piercing structure projecting from said transverse portion having a distal end portion adapted to pierce the membrane as the peripheral part is engaged with the annular lip positioned on the top end of the housing.

2. An assembly according to claim 1 wherein said material is paint.

3. An assembly according to claim 1 wherein said material is a liquid adhesive.

4. An assembly according to claim 1 wherein said material is a liquid sealing material.

5. An assembly according to claim 1 wherein said material is abrasive granules.

6. An assembly according to claim 1 wherein said material is a powder.

7. An assembly according to claim 1 wherein the piercing structure includes an outlet portion having a through central opening and having a periphery firmly engaged with a surface defining the through opening in the adapter assembly, a second opposite end comprising a conical piercing point adapted to pierce through the membrane sealed across the annular lip, and an inlet portion between said outlet portion and said piercing point projecting from said outlet portion and past the peripheral part of the transverse portion, the inlet portion having inlet passageways spaced around its periphery that communicate with the through opening in the outlet portion.

8. An assembly according to claim 7 wherein the filter assembly includes a filter screen extending across the inlet passageways.

9. A method for supplying material to be sprayed for a spraying device, said method comprising the steps of providing a pre-filled container by the steps of providing a stiff annular lip, and a flexible portion fixed to the annular lip having an inner surface defining a cavity in said flexible portion opening through the annular lip, placing a predetermined quantity of the material to be sprayed within the cavity in the flexible portion, and sealing a polymeric membrane across the annular lip to retain the material in the cavity;

providing a housing of stiff material comprising a side wall having a top end and an inner surface defining a recess in the housing, with the top end of the side wall defining an opening into the recess;

positioning the pre-filled container on the housing with the flexible portion in the recess in the housing and the annular lip on the top end of the side wall;

providing an adapter assembly having a through opening between first and second ends, a transverse portion at the first end including a peripheral part adapted for engagement with the annular lip positioned on the top end of the container, and an end portion at the second end adapted to engage the inlet port of the spraying device;

providing a piercing structure projecting from the central portion of the adapter assembly that has a distal end portion adapted to pierce the membrane of the pre-filled container as the peripheral part is engaged with the annular lip positioned on the top end of the housing;

engaging the peripheral part of the adapter assembly with the annular lip positioned on the top end of the housing so that the projecting piercing structure pierces the membrane of the pre-filled container; and securing the peripheral part to the housing with the annular lip therebetween.

10. A method according to claim 9 wherein said step of providing the pre-filled container is performed at a location remote from the other steps of the method.

11. A method according to claim 9 wherein said material is paint.

12. A method according to claim 9 wherein said material is a liquid adhesive.

13. A method according to claim 9 wherein said material is a liquid scaling material.

14. An assembly according to claim 9 wherein said material is abrasive granules.

15. An assembly according to claim 9 wherein said material is a powder.

* * * * *

UNITED STATES PATENT AND TRADEMARK OFFICE

CERTIFICATE OF CORRECTION

PATENT NO. : 6,796,514 B1
DATED : September 28, 2004
INVENTOR(S) : Schwartz, Thomas W.

It is certified that error appears in the above-identified patent and that said Letters Patent is hereby corrected as shown below:

Column 2,
Line 20, delete "arc" and insert -- are --.
Line 36, delete "a dapted" and insert -- adapted --.
Line 56, delete "sup ply" and insert -- supply --.

Column 3,
Line 7, delete "numberal s" and insert -- numerals --.
Line 18, delete "prefilled" and insert -- pre-filled --.

Column 8,
Line 18, delete "cuplike" and insert -- cup-like --.

Column 9,
Line 37, delete "Minn.," and insert -- Minn.; --.
Line 49, delete "HYLP" and insert -- HVLP --.

Column 12,
Line 15, delete "scaling" and insert -- sealing --.

Signed and Sealed this

Twenty-third Day of August, 2005

JON W. DUDAS
*Director of the United States Patent and Trademark Office*